US006079704A

United States Patent [19]

Buck

[11] Patent Number: 6,079,704

[45] Date of Patent: Jun. 27, 2000

[54] TIMING DEVICE FOR WORKHOLDING APPARATUS

[76] Inventor: James R. Buck, 1207 SE. 10th St., Cape Coral, Fla. 33904

[21] Appl. No.: 09/149,188

[22] Filed: Sep. 8, 1998

[51] Int. Cl.[7] ..... B25B 1/10

[52] U.S. Cl. ..... 269/242; 269/43; 269/195; 269/279

[58] Field of Search ..... 269/242, 43, 906, 269/279, 283, 191–195

[56] References Cited

U.S. PATENT DOCUMENTS

| | | | |
|---|---|---|---|
| 805,013 | 11/1905 | Hanimann | 269/195 |
| 2,605,660 | 8/1952 | Firth | 269/193 |
| 5,649,694 | 7/1997 | Buck | 269/43 |
| 5,735,513 | 4/1998 | Toffolon | 269/43 |
| 5,954,320 | 9/1999 | Bohler | 269/43 |
| 5,984,290 | 11/1999 | Durfee, Jr. | 269/906 |

*Primary Examiner*—David A. Scherbel
*Assistant Examiner*—Lee Wilson
*Attorney, Agent, or Firm*—Flynn, Thiel, Boutell & Tanis, P.C.

[57] ABSTRACT

A workholding apparatus has an improved positioning assembly centering top jaw members grippingly supporting a workpiece. The workholding apparatus includes a base member defining a horizontally elongate guide channel which opens upwardly through a top surface to form a guide passage. At least first and second jaw assemblies are disposed in longitudinally spaced relation along the respective guide passage, the first and second jaw assemblies each including a bottom jaw element which is slidably positioned for longitudinal displacement within the guide passage, and a top jaw member releasably mounted on the bottom jaw element. The workholding apparatus includes an actuator assembly for effecting movement of the movable jaw members longitudinally along a path formed by the guide passage. The bottom jaw elements each include a push plate element mounted in the guide passage on the inner side thereof. The positioning assembly includes a rotating member mounted to the base member and first and second pin elements in slots in the respective push plate elements connecting the plate elements to the rotating member. The rotating member controls the relative positions of the first and second push plate elements such that the movable jaw members close on a workpiece at a precise self-centering location.

20 Claims, 6 Drawing Sheets

TIMING DEVICE FOR WORKHOLDING APPARATUS

FIELD OF THE INVENTION

This invention relates to a workholding apparatus for clamping a workpiece, which apparatus is commonly known as a vise, and particularly relates to an improved vise that positions a workpiece at an exact location for further operation by a machine tool, for example an automated machine tool device.

BACKGROUND OF THE INVENTION

It is common practice to utilize a vise for securing a workpiece when performing work on the workpiece. Such vises are typically utilized on precision machining equipment, such as numeric-control equipment, to clampingly hold a workpiece during a defined machining operation. Such vises typically employ a pair of moving jaw members to hold a workpiece at a working station to perform machining operations thereon. The known vises typically utilize a threaded actuator shaft which has reverse threads engaged with both moving jaw members to effect simultaneous opposed movements of the two moving jaw members.

While the known vises have generally performed in a satisfactory manner, nevertheless the known vises have generally possessed minimal accuracy with respect to their ability and precision in securing workpieces at precise locations during various types of desired machining operations.

In addition to the above, known vises have not permitted precise placement of workpieces relative to the positions of machine tools. Secure holding of moving jaw members is needed to insure a secure and precise clamping of the workpiece between the jaw members.

Accordingly, it is an object of this invention to provide an improved vise for permitting secure clamping of a workpiece, such as for permitting machining or other manipulations to be carried out with respect to the workpiece, which vise provides improvements with respect to adaptability and flexibility of use thereof.

Another preferred object of the invention is to provide an improved vise which incorporates hydraulic cylinders at opposing ends, to enable movement of movable jaws to support a workpiece at an exact position.

Another object of the invention is to provide a vise which incorporates a one-piece rotatable actuator shaft which has a screw-thread connection with each of two oppositely movable jaws, which actuator shaft is axially floatedly mounted and cooperates in conjunction with a releasable restraining device associated with only one of the moving jaws so as to permit the moving jaws to be movably displaced during actuation of the vise.

SUMMARY OF THE INVENTION

The vise of the invention, in the preferred embodiment, has first and second jaw assemblies disposed along a guide passage of a base member and an actuator assembly for moving the jaw assembly along a path formed by the guide passage. The jaw assemblies have bottom jaw elements each having a push plate, the push plates being controlled by a rotating member mounted in a cylindrical aperture of the base member such that the movable jaw members close on a workpiece in a self-centering location.

In the vise of this invention, as aforesaid, the guide passage comprises an inverted T-shape and the bottom jaw elements have an inverted T-shaped configuration.

In the vise of the invention, the push plate elements are either fixedly secured to the respective bottom jaw members or integral therewith.

In the vise of the invention, respective sections of the push plate elements extend inwardly in a longitudinal direction along the guide passage and the sections interlock with each other to retain a workpiece.

In the vise of the invention, each top jaw member can be releasably joined to the respective bottom jaw element that is longitudinally slidably disposed within the respective guide passage.

In another embodiment of the invention, an elongate actuator shaft can be rotatably and axially movable and supported and extended in the longitudinal direction of the guide passage, the shaft having first and second threaded shaft portions respectively disposed in threaded engagement with first and second jaw assemblies, the first and second threaded portions being reversely threaded to cause the first and second jaw assemblies to move in opposite directions in response to rotation of the shaft in one rotational direction.

In the vise of the invention, the rotating member includes first and second pin elements, the first and second pin elements rotating with the rotating member in response to advancement of the first and second push elements, the first and second pin elements controlling the relative positions of the first jaw assembly and the second jaw assembly.

In the vise of the invention, the first and second pin elements center a workpiece on the vise, such that the workpiece can be operated on precisely by a machine tool.

The vise of the invention preferably positions the workpiece within two ten-thousandths (0.0002) of an inch of a desired position.

In the vise of the invention, the first and second pin elements are generally disposed in apertures through said push plate elements.

In the vise of the invention, the first and second pin elements rotate the rotating member in response to movement of the push plate elements such that the relative distance between the pin elements remains constant during rotation of the rotating member.

In the vise of the invention, the actuator assembly comprises hydraulic actuators advancing the push plate elements toward each other.

BRIEF DESCRIPTION OF THE DRAWINGS

Other objects and purposes of the invention will be apparent to persons familiar with vises of this general type upon reading the following specification and inspecting the accompanying drawings, in which.

Figure 1:
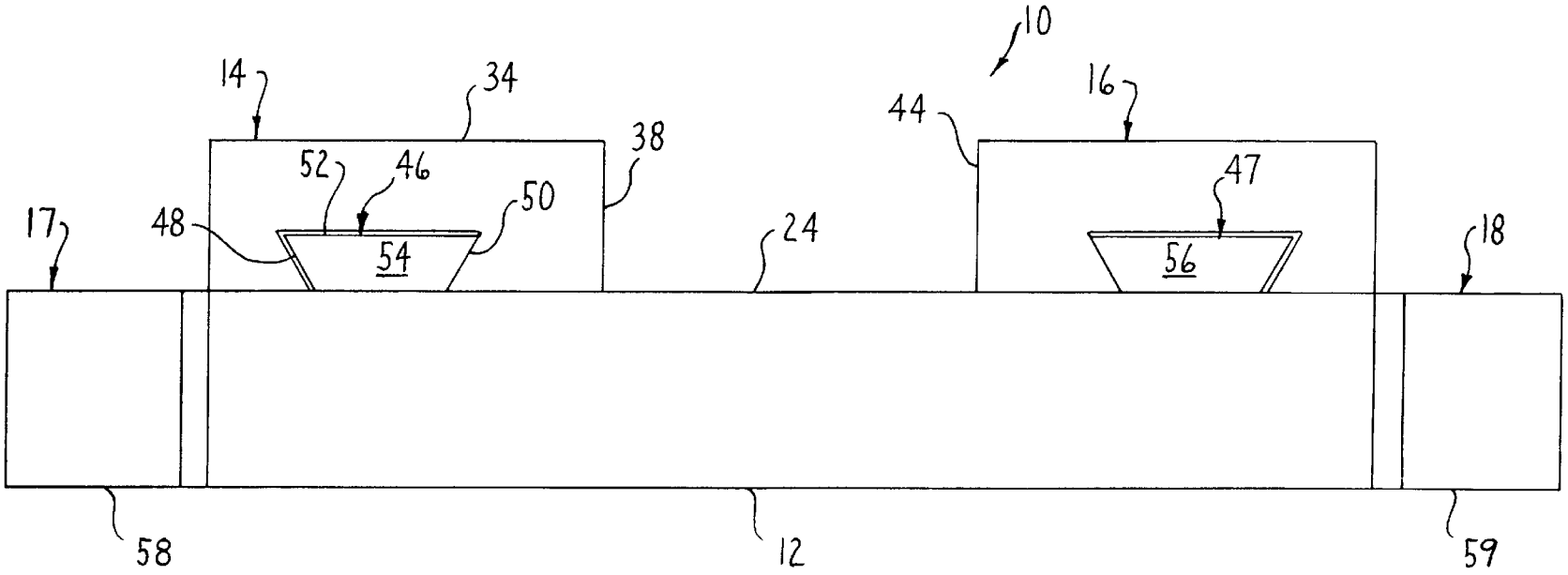
FIG. 1 is a side elevational view of the improved vise according to the present invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the vise and designated parts thereof. Such terminology will include the words specifically mentioned, derivatives thereof, and words of similar import.

DETAILED DESCRIPTION

Referring to the drawings and specifically FIGS. 1–6, there is illustrated a workholding device 10, such as a vise, according to the present invention. This workholding device 10 includes a base member 12, a first left movable jaw assembly 14, and a second right movable jaw assembly 16. A first actuator assembly 17 and a second actuator assembly 18 are associated with respective longitudinal ends of the workholding device 10 for actuating, respectively, the left and right jaw assemblies 14 and 16.

Figure 3:
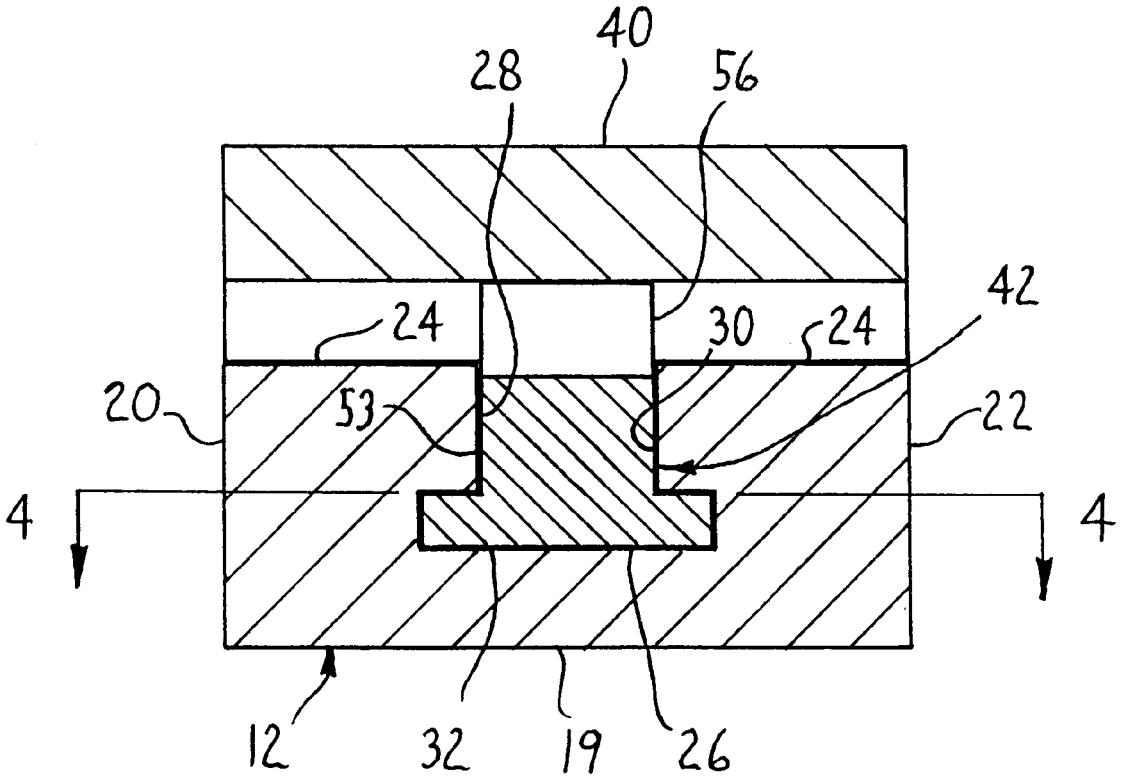
FIG. 3 is a cross-sectional view taken generally along line 3—3 FIG. 2.

Base member 12 includes an elongate U-shaped support block 19 having upwardly projecting side legs 20, 22, as shown in FIG. 3, which at upper ends thereof can have elongate ways or guide elements fixed thereto, the latter defining upper horizontally elongated slide surfaces 24 thereon. Base member 12 defines therein a longitudinally elongated and upwardly opening guide passage 26, the latter being of a generally inverted T-shaped cross section and opening upwardly between the parallel side legs 20, 22. The guide passage defines thereon opposed guide surfaces 28, 30 which define opposite sides of the upper portion of guide passage 26. The bottom of guide passage 26 is defined by a bottom guide surface 32 formed on base member 12.

Figure 2:
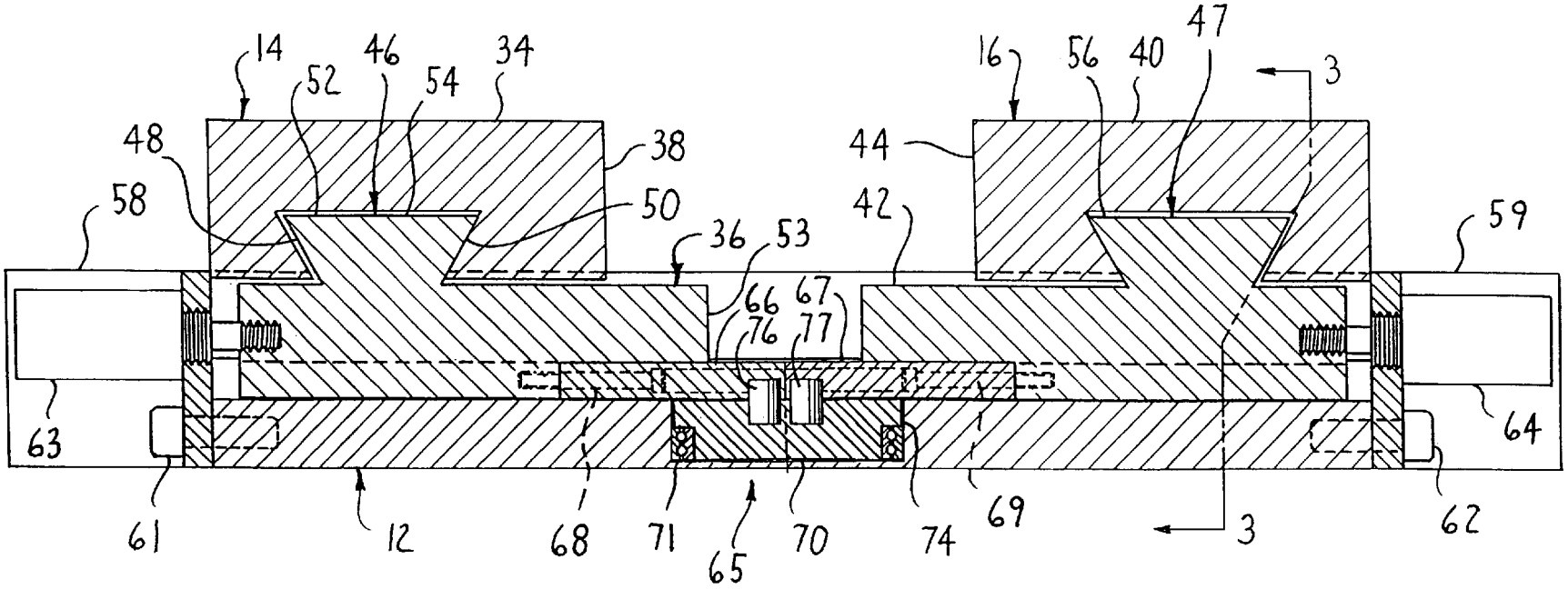
FIG. 2 is a longitudinally extending sectional view taken along line 2—2 of FIG. 4.

Considering now the structure of the left movable jaw assembly 14, it includes a bottom or master jaw element 36, shown in FIG. 2, which is slidably supported generally within the inverted T-shaped guide passage 26, and this bottom jaw element in turn removably mounts thereon a top jaw member 34. This top jaw member 34 defines thereon a jaw gripping surface 38 at an inner side thereof.

Right movable jaw assembly 16 can include a right top jaw member 40 and a right bottom jaw element 42. Right top jaw member 40 can include an opposing gripping surface 44 contoured identically to gripping surface 38.

While these gripping surfaces 38 and 44 are illustrated as planar in FIGS. 1 and 2, it will be appreciated that this is solely for convenience in illustration, and that the gripping surfaces may be provided with whatever contour is desired so as to generally correspond with the configuration of the workpiece surface being gripped. The gripping surfaces can additionally be provided on separate removable jaw plates which attach to the respective top jaw members 34, 40 if desired. Top jaw members 34, 40 are positioned to extend above base member 12 and to extend transversely across the base member. Adjacent opposite ends of top jaw members 34, 40 are provided with generally coplanar bottom surfaces which are slidably supported on upper surfaces 24 of legs 20, 22 for movement along the length of workholding device 10.

Top jaw member 34 defines therein a guide slot 46 which is elongated transversely thereacross, and which opens outwardly through both the bottom of the top jaw member 34 and also outwardly through at least one and preferably both end surfaces thereof. This guide slot 46 preferably has a generally dovetail-shaped cross section as defined between opposed side walls 48 and 50 that project upwardly from the bottom of top jaw member 34 and which not only diverge with respect to one another, but also diverge away from the vertical, preferably at an angle of 45°. These diverging side walls 48 and 50 in turn are joined by a generally horizontally extending top wall 52 that defines the closed end of the guide slot 46.

As to the master or bottom jaw elements 36, 42, they include a base part 53 that is elongated in the longitudinal direction of the base structure and has a generally inverted T-shaped cross section so as to be snugly but longitudinally slidably disposed within the inverted T-shaped guide passage 26. This elongate base part 53 in turn has a keypart 54 formed integrally thereon and projecting upwardly at the upper end thereof, this keypart 54 having a generally dovetail-shaped cross section when viewed in a vertical longitudinal plane. The keypart 54 is defined by side walls which project upwardly from a top wall of the base part, with these side walls diverging outwardly relative to one another and relative to the vertical as they project upwardly. These side walls at their upper ends are in turn joined by a generally horizontally extending top wall. The angle and divergence of the keyway side walls is generally the same as the angle and divergence of the guide slot side walls so that the dovetail-shaped keypart 54 will hence be readily transversely slidably accommodated within the dovetail-shaped guide slot 46. The overall height and width of the guide slot 46, however, will be slightly greater than the corresponding height and width of the keypart 54 to provide sufficient clearance so that the top jaw member 34 can be slidably moved transversely over the way surface into engagement with the keypart 54 until the bottom guide part on the top jaw member 34 passes over the way surface so as to be aligned over and then moved downwardly slightly for positioning between the opposed guide surfaces. Such an arrangement is shown in FIG. 1 where the keyway 54 is visible in the sideview of the invention. The dashed line shown in FIG. 2 near keyparts 54, 56 shows a bottom guide part. When so disposed, the side wall surfaces 48, 50, 52 on top jaw member 34 are engaged with the keypart 54 even though the top jaw member slides in the longitudinal direction on slide surfaces 24 of side legs 20, 22 of support block 19.

While this invention utilizes the keypart 54 or projection for sliding the top jaw member transversely into a mounted position, other arrangements are possible. For example, the takeup assembly set forth in FIG. 8 of U.S. Pat. No. 5,649,694 can be utilized to mount top jaw member 34 to bottom jaw element 36. U.S. Pat. No. 5,649,694 issued Jul. 22, 1997 to Buck is hereby incorporated by reference in its entirety to the extent the patent does not conflict with this disclosure.

The right movable jaw assembly 16 is substantially identical to the jaw assembly 14 described above except that the jaw assemblies 16 and 14 are basically mirror images of one another relative to the center of the vise. In all other respects, top jaw member 40 of right jaw assembly 16 can have a similar dove-tail shaped guide slot 47 and bottom jaw element 42 can have a corresponding keypart 56 capable of fitting in the guide slot.

First actuator assembly 17 and second actuator assembly 18 in FIG. 1 comprise a first end support 58 and a second end support 59. As shown in FIG. 2, end support 58 is secured to base member 12 by screws 61. Likewise, second end support 59 is secured to an opposing longitudinal end of base member 12 by screws 62. First actuator assembly 17 further includes a hydraulic cylinder 63 for applying a hydraulic force to move left jaw assembly 14 inwardly toward right jaw assembly 16. Hydraulic cylinder 63 can include a piston/rod or other actuator device that moves bottom jaw element 36 inwardly in response to increased fluid pressure. Likewise, hydraulic cylinder 64 can be secured to bottom jaw element 42. In the arrangement of FIG. 2, hydraulic cylinders 63, 64 move jaw elements 36, 42 inwardly along a longitudinal path in response to fluid pressure.

FIG. 2 also shows a positioning assembly 65 including push plate elements 66, 67 mounted to respective bottom jaw elements 36, 42 by respective screws 68, 69. Push plate elements 66, 67 extend longitudinally inwardly from the bottom jaw elements and fit along slide surfaces or ways of base member 12 and/or other elements. Thus, during activation of hydraulic cylinders 63, 64, push plate elements 66, 67 can move inwardly toward one another and away from one another a predetermined distance.

As shown in FIG. 2, push plate elements 66, 67 overlie a rotary member 70 of positioning assembly 65 having bearings 71. As shown in FIG. 2, rotary member 70 has a cylindrical shape and lies in a cylindrical bore hole 74 in base member 12. While FIG. 2 shows bore hole 74 having a closed bottom, the bottom can be partially open. In any event, rotary member 70 must be free to rotate in bore hole 74. Bearings 71, of course, assist in enabling free rotation of rotary member 70. The tolerance of rotary member 70 in bore hole 74 must be greater than normal so that the rotary member specifically controls the position of push plate elements 66, 67.

Figure 4:
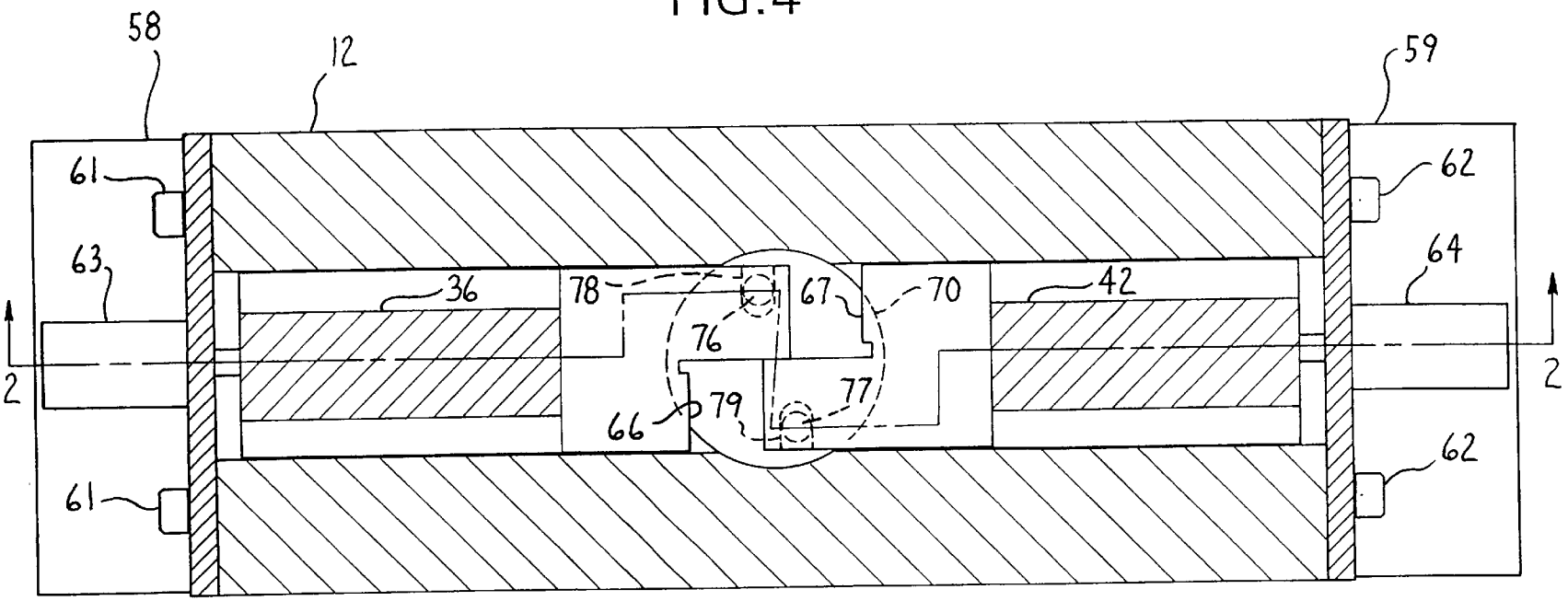
FIG. 4 is a longitudinally extending sectional view taken along line 4—4 in FIG. 3 showing the rotating member in a partially open position.
Figure 5:
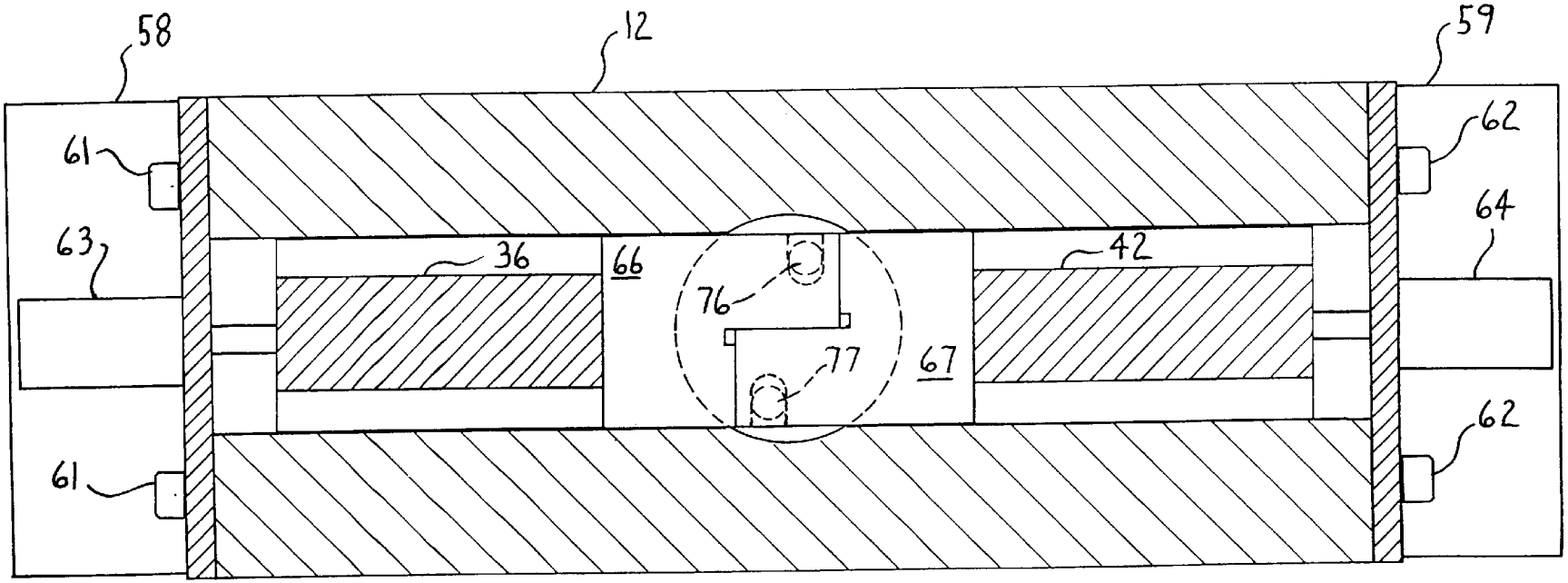
FIG. 5 is a longitudinally extending sectional view similar to the view of FIG. 4, except the rotating member is in the closed position.

Rotary member 70 includes separate pin elements 76, 77. As shown in FIG. 2, pin elements 76, 77 are fitted in closed apertures of rotary member 70 and extend upwardly, in a direction substantially perpendicular to the longitudinal direction, and into slots 78 and 79 provided in respective bottom surfaces of first push plate element 66 and second push plate element 67. As shown in FIG. 4, push plate elements 66, 67 are spaced from each other. However, pin elements 76, 77 secured in rotary member 70 guide or control the relative positions of plate elements 66, 67 with respect to each other. For example, as push plate elements 66, 67 close together or interlock, as shown in FIG. 5, pin elements 76, 77 via rotation of rotary member 70, guide the plate elements positions exactly. In this manner, top jaw members 34, 40 are guided to exact positions relative to each other. This is so because of the exact relative positioning of jaw assemblies 14, 16 required by push plate elements 66, 67 and pin elements 76, 77 of rotary member 70. Therefore, the workholding device 10 can be utilized in combination with a machine tool (not shown) preferably positioned directly above rotary member 70 and over push plate elements 66, 67 to work on a workpiece fixedly held by top jaw members 34, 40.

As shown in FIG. 2, push plate elements 66, 67 are located adjacent and above rotary member 70. Pin elements extend upwardly from rotary element 70. While bearing 71 supports rotary member 70 about its perimeter, an axial support shaft or screw can support rotary member 70 provided the same plane of rotation and tolerance can be achieved.

The travel between the open jaws position shown in FIG. 4, and the closed jaws position of FIG. 5 corresponding to the rotation of rotary member 70 and closing of push plate elements 66, 67 preferably can be along the order of about 1 to 2 inches. Other distances can be utilized as desired. Further, other top jaw members 34, 40 can be utilized having different dimensions such that the distance between the jaw members is greater or less when the push plate elements 66, 67 are in the closed position shown in FIG. 5.

The force of first and second hydraulic cylinders 63, 64 may not be exactly the same. Any difference in force is transferred through the respective bottom jaw element and push plate, then through rotary member 70 via pin elements 76, 77 to the other bottom jaw element. Thus, such an arrangement balances the forces applied, and locates top jaw members 34, 40 at relative specified positions from each other. This is shown by the relative positions of push plate elements 66, 67 with respect to rotary member 70. The distance between pin elements 76, 77 does not vary during closing of the jaws. Rotating element 70 merely rotates pin elements 76, 77 thereabout as jaw members 34, 40 converge. The tolerance of pin elements 76, 77 with respect to slots 78, 79, as well as rotating element 70 and bore hole 74, must be very exact, above and beyond normal tolerances for the invention to have exact centering or positioning when utilized.

Above all else, the exact positioning of a workpiece is caused by the above arrangement such that automatic operation on workpieces can be done with minimal manual operation.

While pin elements 76, 77 are shown as being supported in apertures in rotating member 70, the pin elements can comprise an integral part of the rotary member. The positioning assembly 65 can position a workpiece between top jaw members 34, 40 at an exact location within about 0.0002 inch of a desired location. Such precise centering of a workpiece enables a machine tool to work on the piece with little or no operator involvement.

While the above arrangement does not show a fixed jaw member, any arrangement of jaw members can be utilized so long as at least two of the jaw members have a novel relative positioning arrangement as disclosed herein.

Figure 6:
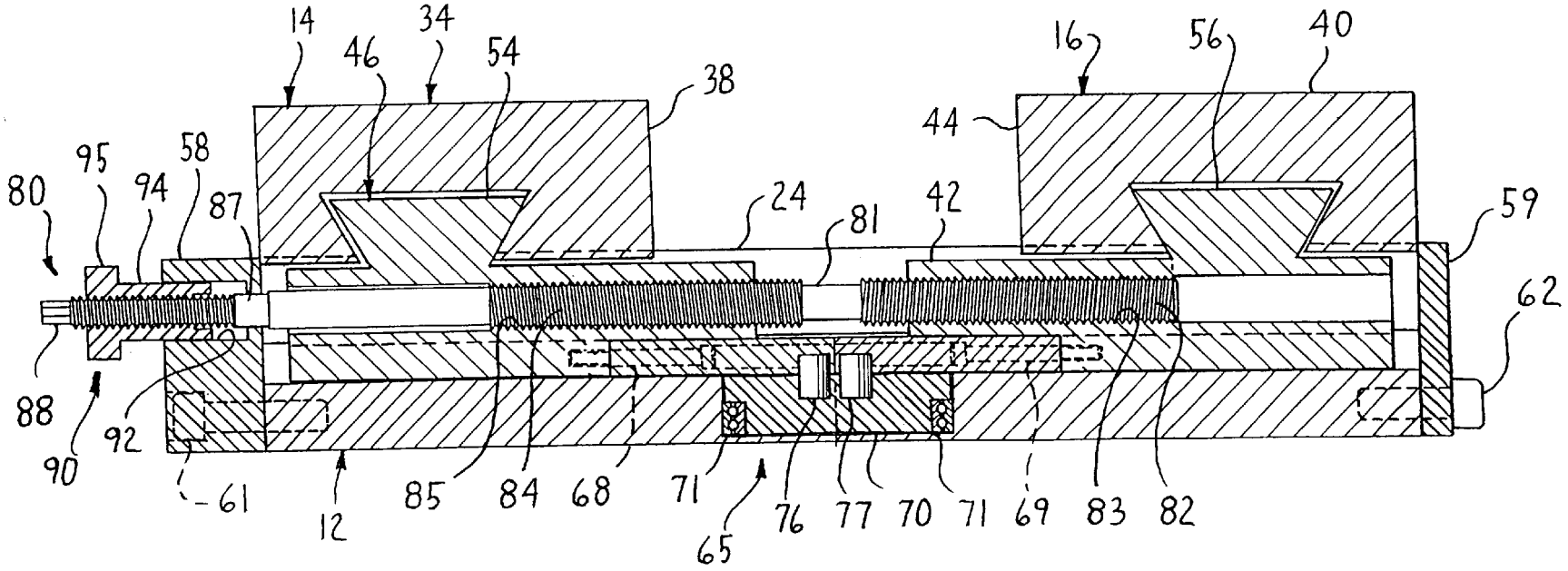
FIG. 6 shows a longitudinally extending sectional view of a second embodiment of the invention having a screw type actuator.

FIG. 6 shows another embodiment of the invention where the workholding device 10 of FIG. 1 is modified to include a more conventional actuator drive assembly 80. Actuator drive assembly 80 includes an elongate actuator shaft 81 rotatable about its longitudinal axis, the latter extending longitudinally of the base structure in generally parallel relationship with way surfaces 24. Actuator shaft 81 is disposed generally within and extends longitudinally along the guide passage 26 (see FIG. 3) and includes thereon a first externally threaded part 85 which extends through a threaded bore 83 formed in the bottom right jaw element 42. At least a part of this bore 83 is internally threaded and maintained in threaded engagement with externally threaded shaft part 82. In similar fashion, actuator shaft 81 has a second further externally threaded shaft part 84 which is spaced axially from the threaded shaft part 82 and which extends through a further bore 85 formed in the left bottom jaw element 36. At least part of this bore 85 is also internally threaded and is maintained in threaded engagement with threaded shaft part 84. The externally threaded shaft parts 82 and 84, as well as the associated internally threaded bores, are reversely threaded in that one is a right-hand thread and the other a left-hand thread so that movement of the lower jaw elements 36 and 42 relative to rotating shaft 81 is in opposite linear directions.

The actuator shaft 81, at the leftward end in FIG. 6, includes an elongate shaft part 87 which projects outwardly beyond base member 12 and at its free end terminates in an actuator part 88, the latter being of non-circular cross section such as square or hexagonal so as to accommodate thereon a driving wrench or socket for permitting rotating of the shaft 81 when desired.

An adjustment structure 90 cooperates between the elongate shaft part 87 and the base member 12 for both assisting in the rotatable support of the shaft 81, and at the same time selectively supporting the shaft either for free axial floating movement or axially restraining the shaft relative to base member 12. This adjustment structure 90 includes an end support 58 which overlaps and is fixedly secured to the end of base member 12, and has an opening 92 therethrough which provides rotatable support for the elongate shaft part 87. The adjustment structure also includes an adjusting sleeve or nut 94 which surrounds the projecting shaft part, this adjustment sleeve 94 being internally threaded and maintained in threaded engagement with an externally threaded portion of the shaft part 87. The sleeve 94 has a generally cylindrical exterior configuration which is slidably accommodated within an enlarged cylindrical bore formed in end support 58 in coaxial alignment with the opening 92.

The actuator shaft 81 is also provided with an enlarged hub or shoulder which is disposed in opposed and facing relationship to, but is typically spaced inwardly away from, the inner surface of the end support 58.

Adjusting sleeve 94 preferably has an enlarged flange or hub 95 at the outer end thereof to facilitate engagement or gripping of the nut, either manually or by means of a tool, when rotational adjustment of the nut is desired.

The purpose of adjustment structure 90 in enabling free axial floating movement or restraining actuator drive shaft 81 relative to base member 12 is described in detail in U.S. Pat. No. 5,649,694, previously incorporated by reference herein.

The positioning assembly 65 including rotating member 70, push plate elements 66, 67 and pin elements 76, 77, in combination with jaw assemblies 14, 16, function in a manner similar to the embodiment described earlier for FIGS. 1–5.

The various modes of operation of the workholding device 10 of FIG. 6 will now be briefly described to insure a more complete understanding of the invention. In operation, a workpiece is placed between top jaw members 34, 40. Actuator shaft 81 is driven at actuator part 88 by a rotating drive apparatus (not shown). The drive apparatus rotates shaft 81 moving top jaw members 34, 40 toward each other, securing a workpiece at gripping surfaces 38, 44. Then, a machine tool (not shown) can work on the workpiece so held. Positioning assembly 65 ensures the relative position of the workpiece does not vary despite potential errors caused by varying tolerances in the threads of actuator shaft 81 or threaded bores 83, 85.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A workholding apparatus for grippingly supporting a workpiece to enable machining operations to be carried out thereon, comprising:

a base member defining a horizontally elongate guide channel which opens upwardly through a top surface; the guide channel forming a guide passage;

at least first and second jaw assemblies disposed in longitudinally spaced relation along the respective guide passage, said first and second jaw assemblies each including a bottom jaw element which is slidably positioned for longitudinal displacement within the guide passage, and a top jaw member extending transversely across the guide passage and being slidably mounted on said base member, said top jaw member being releasably mounted on said bottom jaw element;

an actuator assembly for effecting movement of said movable jaw assemblies longitudinally along a path formed by the guide passage;

said bottom jaw elements each including a push plate element mounted in the guide passage on the inner side thereof; and a rotating member mounted to said base member below said push plate elements, said rotating member including a means for controlling the relative positions of said first and second push plate elements such that said movable jaw members close on a workpiece in a self-centering location.

2. The workholding apparatus according to claim 1, wherein said actuator assembly comprises hydraulic actuators moving said push plate elements toward and away from each other.

3. The workholding apparatus according to claim 1, wherein the guide passage has an inverted T-shape.

4. The workholding apparatus according to claim 2, wherein said bottom jaw elements have a generally inverted T-shaped configuration.

5. The workholding apparatus according to claim 1, wherein said push plate elements are fixedly secured to said respective bottom jaw elements.

6. The workholding apparatus according to claim 1, wherein said push plate elements are integral with said respective bottom jaw elements.

7. The workholding apparatus according to claim 1, wherein respective sections of said push plate elements extend inwardly in a longitudinal direction along the guide passage and the sections interlock with each other, when said jaw members close, to retain a workpiece.

8. The workholding apparatus according to claim 1, wherein each said top jaw member is releasably joined to said respective bottom jaw element that is longitudinally slidably disposed within the respective guide passage.

9. The workholding apparatus according to claim 1, wherein an elongate actuator shaft rotatably and axially movable is supported and extends in the longitudinal direction of the guide passage, said shaft having first and second threaded shaft portions respectively disposed in threaded engagement with said first and second jaw assemblies, said first and second threaded portions being reversely threaded to cause said first and second jaw assemblies to move in opposite directions in response to rotation of said shaft in one rotational direction.

10. The workholding apparatus according to claim 1, wherein said means for controlling the relative position of said push plate includes first and second pin elements, said first and second pin elements rotating with said rotating member in response to advancement of said first and second push elements, said first and second pin elements effecting a controlling of the relative positions of said first jaw assembly and said second jaw assembly.

11. The workholding apparatus according to claim 10, wherein said first and second push elements meet one another and interlock at a predetermined distance between said first jaw member and said second jaw member.

12. The workholding apparatus according to claim 10, wherein said first and second pin elements effect a centering of a workpiece on said apparatus, such that the workpiece can be operated on precisely by a machine tool.

13. The workholding apparatus according to claim 12, wherein said apparatus positions the workpiece within about two ten-thousandths of an inch of a desired position.

14. The workholding apparatus according to claim 10, wherein said first and second pin elements are disposed in slots in said push plate elements.

15. The workholding apparatus according to claim 14, wherein said first and second pin elements rotate with said rotating member in response to movement of said push plate elements such that the relative distance between said pin elements remains constant during rotation of said rotating member, said rotating member rotating in a plane below the plane of movement for said push plate elements.

16. A vise for grippingly supporting a workpiece to enable machining operations to be carried out thereon, comprising:

a base member defining a horizontally elongate guide channel which opens upwardly through a top surface; the guide channel forming a guide passage;

at least first and second jaw assemblies disposed in longitudinally spaced relation along the respective guide passage, said first and second jaw assemblies each including a bottom jaw element which is slidably positioned for longitudinal displacement within the guide passage, and a top jaw member being releasably mounted on said bottom jaw element;

an actuator assembly for effecting movement of said movable jaw members longitudinally along a path formed by the guide passage;

said bottom jaw elements each including a push plate element mounted in the guide passage on the inner side thereof;

a rotating member mounted to said base member; and first and second pin elements for connecting said respective push plate elements to said rotating member, wherein said first and second pin elements are secured to said rotating member to prevent pivoting movement of said pin elements with respect to said rotary member.

17. A vise according to claim 16, wherein said rotating member includes means for controlling the relative positions of said first and second push plate elements such that said movable jaw members close on a workpiece in a self-centering location.

18. A vise according to claim 16, wherein the guide passage has an inverted T-shape and said bottom jaw elements have a generally inverted T-shaped configuration.

19. A vise according to claim 16, wherein said push plate elements each extend inwardly in a longitudinal direction along the guide passage and are capable of interlocking with each other, when said jaw members close, to retain a workpiece.

20. A vise according to claim 16, wherein said first and second pin elements are disposed in slots through said push plate elements and said first and second pin elements remaining a constant distance from each other as said rotating member rotates.

* * * * *